US005611658A

United States Patent [19]

Olofsson et al.

[11] Patent Number: 5,611,658

[45] Date of Patent: Mar. 18, 1997

[54] METHOD AND APPARATUS FOR DESTACKING SHEET METAL MEMBERS

[75] Inventors: Bengt Olofsson; Jimmy Olsson; Milan Remen, all of Olofström; Kenneth Gullberg, Ryd, all of Sweden

[73] Assignee: AB Volvo, Gothenburg, Sweden

[21] Appl. No.: 335,803

[22] PCT Filed: Apr. 16, 1993

[86] PCT No.: PCT/SE93/00333

§ 371 Date: Jan. 24, 1995

§ 102(e) Date: Jan. 24, 1995

[87] PCT Pub. No.: WO93/23321

PCT Pub. Date: Nov. 25, 1993

[30] Foreign Application Priority Data

May 13, 1992 [SE] Sweden ..... 9201507

[51] Int. Cl.[6] ..... B21D 43/24

[52] U.S. Cl. ..... 414/797.3; 414/797.2; 414/795.7

[58] Field of Search ..... 198/625, 467.1; 414/796.5, 797.3, 797.9, 797.2; 271/10.06, 10.09, 21, 34, 109, 161

[56] References Cited

U.S. PATENT DOCUMENTS

| | | | |
|---|---|---|---|
| 3,391,926 | 7/1968 | Jaatinen | 414/797.3 |
| 4,447,053 | 5/1984 | Wager et al. . | |
| 4,482,144 | 11/1984 | Glassby | 414/797.3 |
| 4,511,134 | 4/1985 | Hughes . | |
| 4,595,188 | 6/1986 | Wiley et al. . | |

FOREIGN PATENT DOCUMENTS

| | | | |
|---|---|---|---|
| 551629 | 12/1959 | Belgium | 414/796.5 |
| 799182 | 6/1936 | France . | |
| 2477120 | 9/1981 | France . | |
| 258382 | 4/1913 | Germany . | |
| 372401 | 3/1923 | Germany . | |
| 2445986 | 4/1976 | Germany . | |
| 63-17741 | 1/1988 | Japan . | |
| 76643 | 4/1950 | Norway . | |
| 402497 | 10/1973 | U.S.S.R. | 414/796.5 |
| 870-322 | 10/1981 | U.S.S.R. . | |
| 1217535 | 3/1986 | U.S.S.R. | 414/797.9 |
| 1680417 | 9/1991 | U.S.S.R. . | |

*Primary Examiner*—Karen B. Merritt
*Assistant Examiner*—Gregory A. Morse
*Attorney, Agent, or Firm*—Varnum, Riddering, Schmidt & Howlett

[57] ABSTRACT

A device for separating flat objects such as sheet metal blanks has a pair of separator devices which apply a force to the edges of the objects at an angle to a normal of the plane of the objects. In one embodiment, the separator devices are screws which are rotated in opposite directions to lift opposite edges of the objects. As the object is lifted, the angle of the screws becomes more nearly vertical.

19 Claims, 8 Drawing Sheets

METHOD AND APPARATUS FOR DESTACKING SHEET METAL MEMBERS

TECHNICAL FIELD

The present invention relates to a method of destacking, or separating, from one another sheet or panel-shaped, substantially planar objects such as sheet metal members which form a stack, the separation being effected in a separation direction which is substantially parallel with a normal to the plane of those objects which are to be separated and is executed by at least one separator device.

The present invention also relates to an apparatus for destacking, or separating, sheet or panel-shaped, substantially planar objects such as sheet metal members which form a stack, comprising at least one separator device such as a screw or the like which presents to the stack a number of engagement members which, seen from the stack, are movable in a feeding direction in order, by engagement with the stack, to separate objects therefrom piecewise.

BACKGROUND ART

In the production of various products of sheet metal by pressing, use is often made of sheet metal blanks which are piled into stacks in which the individual blanks lie directly on top of one another. The sheet metal blanks often carry an oil film, which entails that they show a manifest tendency to adhere to one another. On removal of the sheet metal blanks for further processing in a press or press line, use is made of different forms of gripping devices which, for example, may consist of suction cups which are applied to the uppermost sheet in the stack and which lift the sheet from the stack and move the sheet into the tool in the press.

If the sheets consist of magnetic material, the adhesive action of the oil film can be cancelled out by magnetic separators which prevent the suction cups from taking two or more sheets at the same time, which would cause immediate operational stoppage in the pressing operation.

If the sheets consist of non-magnetic material, for example aluminium, the technique employing magnetic separation will not function, for which reason adhesion between the sheet blanks implies almost constant operational stoppage.

In other technical fields of application in which separation of members or objects disposed in a stack has been brought into consideration, use has been made of screw-shaped separator devices which, with their threads, grip in between adjacent objects and lift out the uppermost object from the stack. In such instance, the axes of rotation of the screws are parallel with the edge of the stack, i.e. also parallel with a normal to the plane of that object or member which is to be separated.

This technique, known from the packaging industry, functions well only in such contexts where those portions of the objects which are grasped by the screws are spaced apart from one another such that the screw thread can pass into these gaps without damaging the objects. On the other hand, it is impossible to apply this technique successfully in such cases in which the objects or members form a compact stack which, thus displays no spacings between those portions of the objects which serve for engagement for the screws.

Nor can the technique known from the packaging industry be employed in such cases in which those objects which are to be separated do not lie in well-arranged stacks, such that individual objects may project out laterally beyond the rest of the stack. Precisely such poor precision in the stacks, i.e. individual sheets or groups of sheets projecting laterally out from the stack is difficult to avoid in the feeding of sheets to, for example, a press.

Despite the above-outlined problems in compact stacks and employing screws whose axes of rotation are parallel with the edge of the stack, Russian patent specification 870 322 discloses a solution which is based on this principle. In the design and construction according to this Russian patent publication, use is made of a screw whose thread has a sharp knife edge which projects out along a radius and which is intended to cut in between two adjacent sheets. Naturally, extremely strict requirements on precision are placed here if such an apparatus is to be capable of separating from one another metal sheets of the order of thickness of between 0,5 and 1,0 mm. Even one or a couple of tenths of a millimetre of incorrect placement of the cutting edge in relation to the stack will result in the sheets being damaged and deformed—with an imminent risk of operational stoppage. There is a risk of exactly the same outcome if the sheets in the stack suffer from edge damage resulting, for example, from impact. How great these precision problems can be is most readily apparent from the fact that the sheets under consideration here are a square metre or more in size and that the stack may weigh several tonnes.

SUMMARY OF THE INVENTION

The present invention has for its object to realise a method of the type mentioned by way of introduction, the method permitting a reliable and efficient separation of the metal sheets in a stack from one another so that only one sheet member is grasped at a time. The present invention further has for its object to realise a method which may be reduced into practice using simple and versatile means so that variations in sheet metal thickness and sheet dimensions—and also in the position of the individual sheets—may thereby readily be managed.

The present invention yet further has for its object to devise an apparatus of the type mentioned by way of introduction, the apparatus being of such a nature that it affords an extremely operationally reliable separation of the metal sheets from one another, that it is simple and economical to manufacture, and that it is versatile so that it may readily be used for sheets of varying thickness and otherwise varying dimensions and also for sheets whose position in the stack may vary. In addition, the present invention relates to an apparatus which affords an accurate positioning of the destacked sheet metal member when this is to be grasped by a gripping device for infeed into a subsequent processing machine.

The objects forming the basis of the present invention will be attained, in respect of the method, if the method is characterized in that an edge portion of the member or object which is to be separated is subjected, by the separator device, to a force which has a first component directed with and substantially parallel with the separation direction, and a second component substantially parallel with the plane of the object which is to be separated and directed from the separator device in towards the object.

The objects forming the basis of the present invention will be attained, in respect of the apparatus, if the apparatus is characterized in that the feeding direction makes an angle with the normal to that object which is to be separated; and that the separator device is in abutment against the stack at one edge of that object which is to be separated.

BRIEF DESCRIPTION OF THE ACCOMPANYING DRAWINGS

The present invention will now be described in greater detail hereinbelow, with particular reference to the accompanying Drawings. In the accompanying Drawings:

FIG. 1 schematically illustrates a vertical front elevation of a first embodiment of the present invention;

DESCRIPTION OF PREFERRED EMBODIMENT

Figure 1:
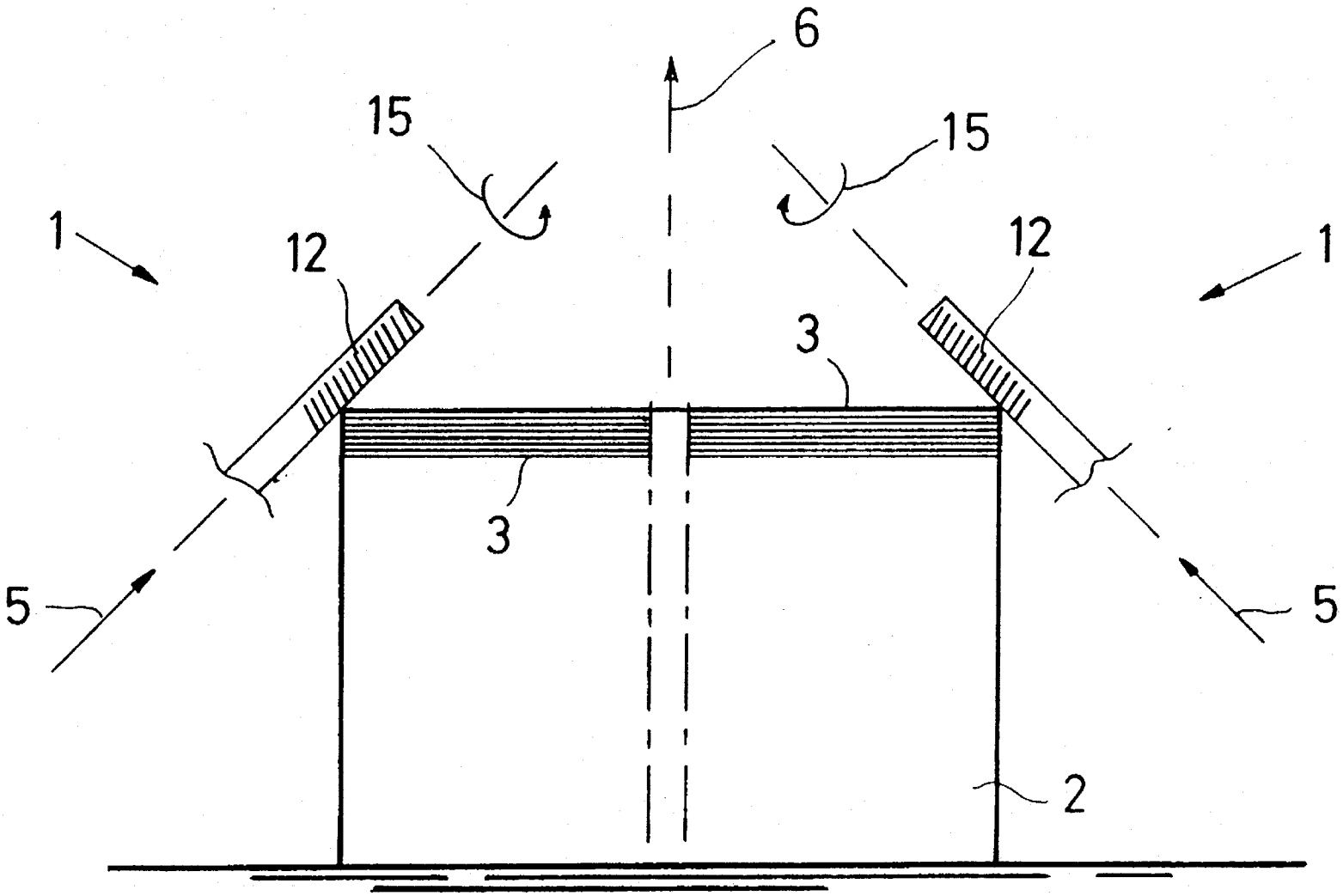

In its most generic form, the apparatus according to the present invention comprises at least one separator device 1 in abutment against an upper edge portion of that stack 2 of objects 3 which are to be separated from one another so that adhesion between the objects caused by oil film or other agents may thereby be canceled and the uppermost object in the stack can be grasped by a gripping device 4 for infeed into a processing machine, for example a press. The separator device 1 has at least one, possibly more, engagement members which, seen from the stack 2 in sequence after one another,move along a feeding direction 5 away from the stack. The intended separation or partitioning direction 6 is parallel with or substantially parallel with a normal to the plane of extent of the objects 3.

The feeding direction 5 makes an angle with the separation direction 6 and inclines inwardly and upwardly over the objects 3 and thereby subjects the objects to a force component substantially parallel with the separation direction 6 and a force component approximately parallel with the plane of extent of the objects 3, this second force component being directed away from the separator device in towards the stack 2 transversely of or substantially at right angles to that edge of the object 3 against which the separator device abuts. The separator device engages with an upper corner edge portion of the stack 2, i.e. with an edge of the uppermost object 3, and the feeding direction 5 can make an angle with the separation direction 6 of the order of magnitude of between 20°and 60°, preferably approx. 45°. This angle may vary during a separation cycle and be reduced from a relatively large starting value (60°–40°) to a smaller final value (40°–20°). The angle may also be constant.

FIG. 1 shows two opposing separator devices 1, but, according to the present invention, it is sufficient in certain cases with but a single separator device if the opposingly located edge of the stack 2 in relation to the separator device is supported by a fixed arrest which prevents displacement of the objects 3 in this direction, i.e. in a direction away from the separator device.

In the alternative with the single separator device and an arrest, the separator device will, in the normal case, enter into engagement with the upper edge portion of the uppermost object 3 in the stack. This upper edge portion is subjected to a force, on the one hand, in the separation direction 6 and, on the other hand, in the plane of extent of the object so that this tends to be lifted and displaced into abutment against the arrest if such abutment does not already exist beforehand. As soon as the uppermost object has been stopped by the arrest, its edge in engagement with the separator device will be separated from the subjacent stack and be lifted away therefrom so that the adhesive action of the oil film is broken.

In order to permit the above-described movement, it is necessary that the separator device 1 can be pivoted away from the stack 2 to some extent or be displaced away from it in order thereby to avoid bending and deforming of the object 3.

If, for example, the next uppermost sheet in a stack 2 were to project out beyond the stack in a direction towards the separator device, the separator device will first come into engagement with this sheet. In such an event, the sheet will, on the one hand, be lifted from the stack in the separation direction 6 but will also be displaced in the plane of extent of the sheet as soon as the adhesive action of the oil film has been reduced or cancelled. In such instance, the sheet will be slid into contact against the arrest member, in which event the separator device will instead enter into engagement with the uppermost sheet in the stack, since the separator device inclines in a direction in over the stack. Thereafter, separation of the uppermost sheet continues in the manner described in the foregoing.

In the alternative with two opposing separator devices 1, engagement will be established in the normal case (no sheet projecting out laterally to any appreciable degree) approximately simultaneously between the separator devices 1 and opposing edges of the uppermost sheet 3, whereafter the opposing edges of the sheet are raised so that adhesion with the subjacent sheet is broken.

In such an alternative in which, for example, the next uppermost sheet projects out laterally, this will be grasped by the separator device located there. Approximately at the same time, the uppermost sheet will be grasped by the other separator device. As soon as the projecting sheet has been lifted by its separator device from the stack, it will be displaced laterally in under the uppermost sheet, for which reason engagement will be moved up to this sheet which is then lifted from the subjacent sheet.

Figure 2:
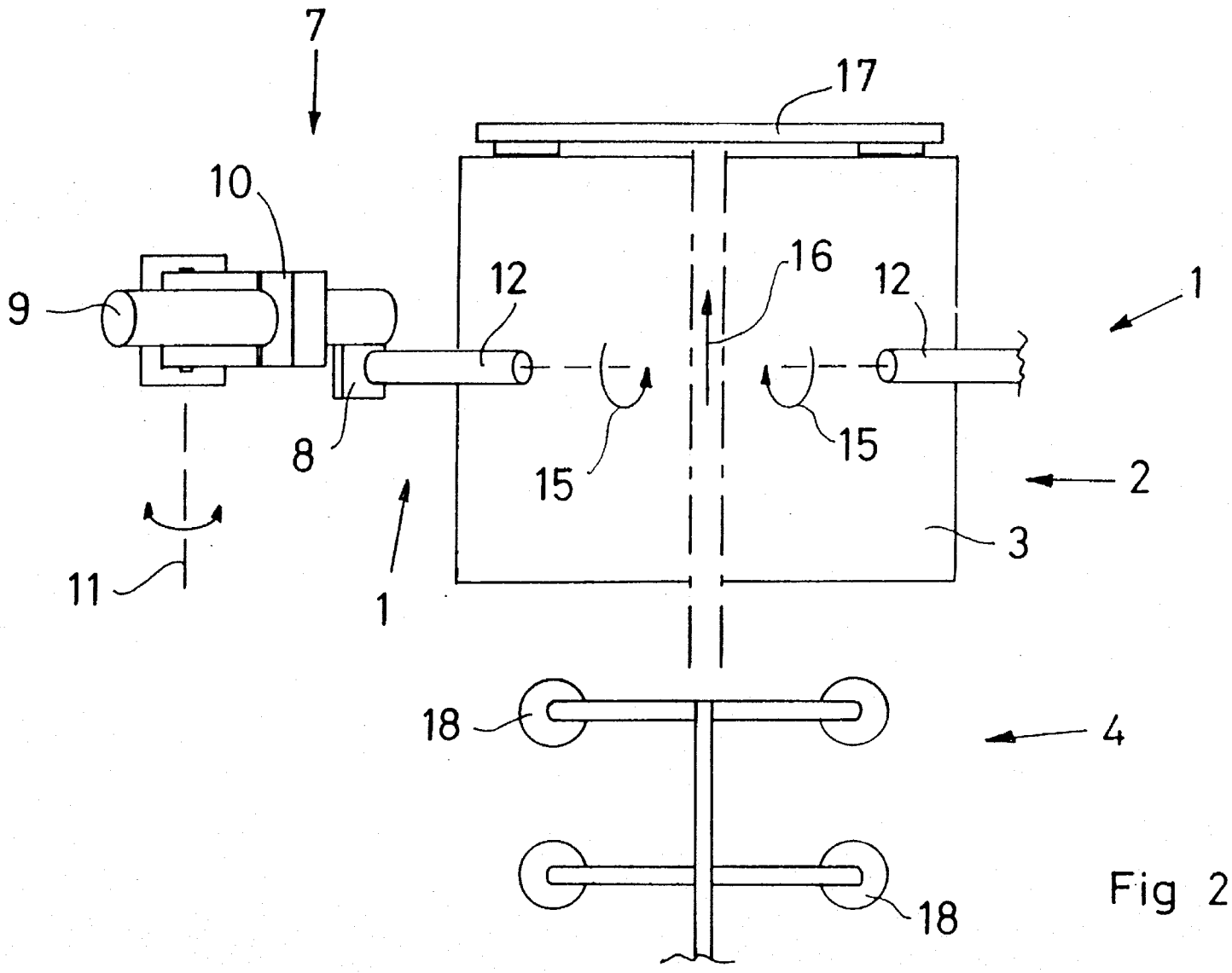
FIG. 2 is a top plan view of the embodiment of FIG. 1.
Figure 3:
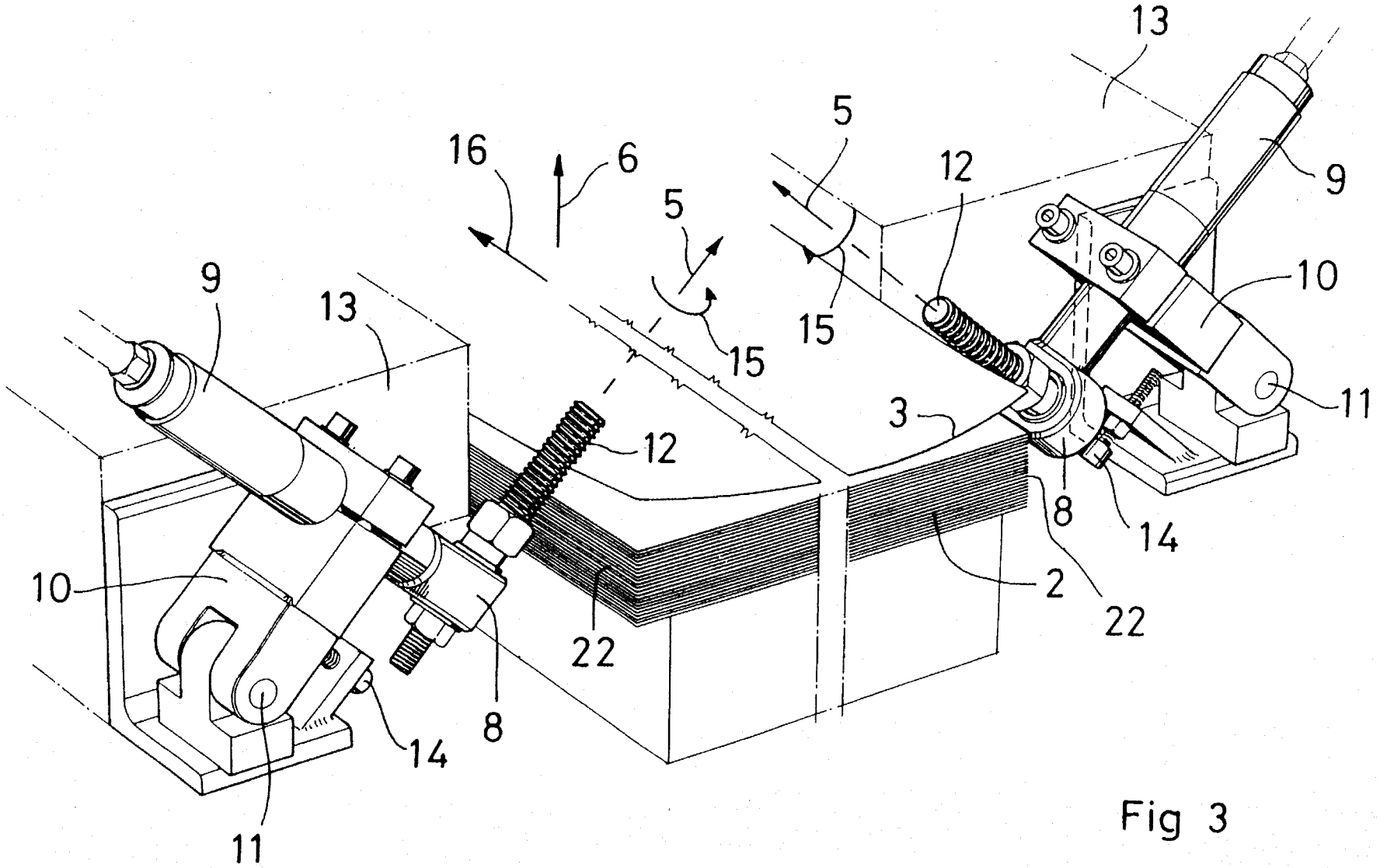
FIG. 3 is a perspective view of the embodiment according to FIGS. 1 and 2.

In the embodiment illustrated in FIGS. 1–3, use is made of two opposing separator devices 1 in the form of threaded worms or screws 12 which abut against the upper opposing corner edges of the stack 2. For reasons which will be elaborated upon below, the screws 12 are disposed for counter-rotation and, therefore, their threads are also of opposite turn.

The screws each have their drive unit 7 which comprises a gear 8 and a motor 9. The drive unit 7 is suspended in a bracket 10 which is pivotal about a shaft 11 so that thereby the screws may execute pivoting motions and thereby be distanced from one another according as an object 3 is led up along the screws. This pivoting entails that the angle between the separation direction 6 and the feeding direction 5 will gradually decrease as the separation and pivoting of the screws 12 continues.

The pivot shaft 11 is placed in such a manner in relation to the centre of gravity of the bracket 10, the drive unit 7 and the screw 12 that the screws strive to be pivoted in towards the stack 2 and abut against the stack. As a result, the screws will be pretensioned in a direction in towards the stack.

It will be apparent from FIG. 3 that the drive units 7 are secured via the shafts 11 to abutments 13 which are located closely adjacent the side edges 22 of the stack 2 against which the screws 12 abut. It will also be apparent that these abutments 13 are of such height as to extend up over the uppermost sheet 3 in the stack 2.

In order to function satisfactorily, the pitch of the screws 12 must approximate or preferably exceed the sheet thickness. At the same time, there is hardly any upper limit to the distance between two mutually subsequent engagement members or threads, but, for practical reasons, this distance should not substantially exceed twice the sheet thickness. Given that the subject matter of the present invention is intended to be usable in connection with varying thicknesses, it will be readily perceived that the screws 12 must be replaceably secured in the drive units 7, preferably the gears 8.

Practical experiments have demonstrated that the function of the apparatus will be satisfactory if the pitch of the screws 12 lies in the range of between 1.2 and 1.8 times the relevant sheet thickness. However, the pitch should preferably be about 1.5 times the sheet thickness and the thread profile should be symmetrical (ISO profile) with a slightly rounded thread crest, at least if the material in the sheets is soft, as is the case with aluminium.

It will be apparent from FIG. 3 that the pivoting of the drive units in towards the stack 2 may be governed with the aid of an adjustment screw 14 which is disposed on a foundation portion of the drive unit. In order to ensure satisfactory function while in operation, this adjustment screw should, however, not abut against the bracket but serve substantially so as to prevent exaggerated pivoting of the drive unit if the sheet stack were to be completely emptied.

It was mentioned above that the pivot shaft 11 is located such that the point of gravity realises a suitable pretensioning force between the screws 12 and the sheet stack 2. Naturally, such pretensioning may also be achieved by other forms of pretensioning devices, for example springs, pneumatic or hydraulic cylinders and the like.

It was also mentioned above that the screws 12 should be counter-rotating, and be of opposite turn. In such instance, the directions of rotation should lie as shown in the Figure at the arrows 15. The reason for this is that those friction forces which occur between the screw periphery and the uppermost sheet 3 give a third force component against the sheet, this force component being located in the plane of extent of the sheet and being directed as shown by the arrow 16. When, thus, the uppermost sheet becomes free from the subjacent stack, the screws 12 strive to displace the sheet in the direction of the arrow 16. In order to prevent such displacement, use is made of an abutment 17 (FIG. 2) which guarantees accurate positioning of the uppermost sheet when this is to be grasped by the gripping device 4 which preferably is provided with suction cups 18.

By using the opposing abutments 13, it will be ensured that the sheet is located within the tolerance range which is indicated by the size difference between the sheet and the distance between the abutments 13. The striving on the part of the screws 12 to displace the sheet in a direction according to the arrow 16 towards the the abutment 17 further entails that the position of the sheet is very well defined also in this direction, for which reason the gripping devices 4 can deliver a sheet to a processing machine with a high level of precision.

As operation of the apparatus according to FIGS. 1 to 3 continues, the height of the stack 2 will be reduced. This would entail that the drive units 7 were pivoted more and more towards one another in over the stack 2. In order to keep the angle between the intended separation direction 6 and the feeding directions 5 of the separator device 1 within permitted limits, either the stack 2 is raised by degrees as operation continues, or the drive units 7 and the screws 12 are lowered together with the abutments 13.

In order not to need modifying the range of movement of the gripping device 4, the alternative employing raising of the stack 2 is to be preferred so that thereby the upper face of the stack will constantly be at approximately the same level.

DESCRIPTION OF ALTERNATIVE EMBODIMENTS

Figure 4:
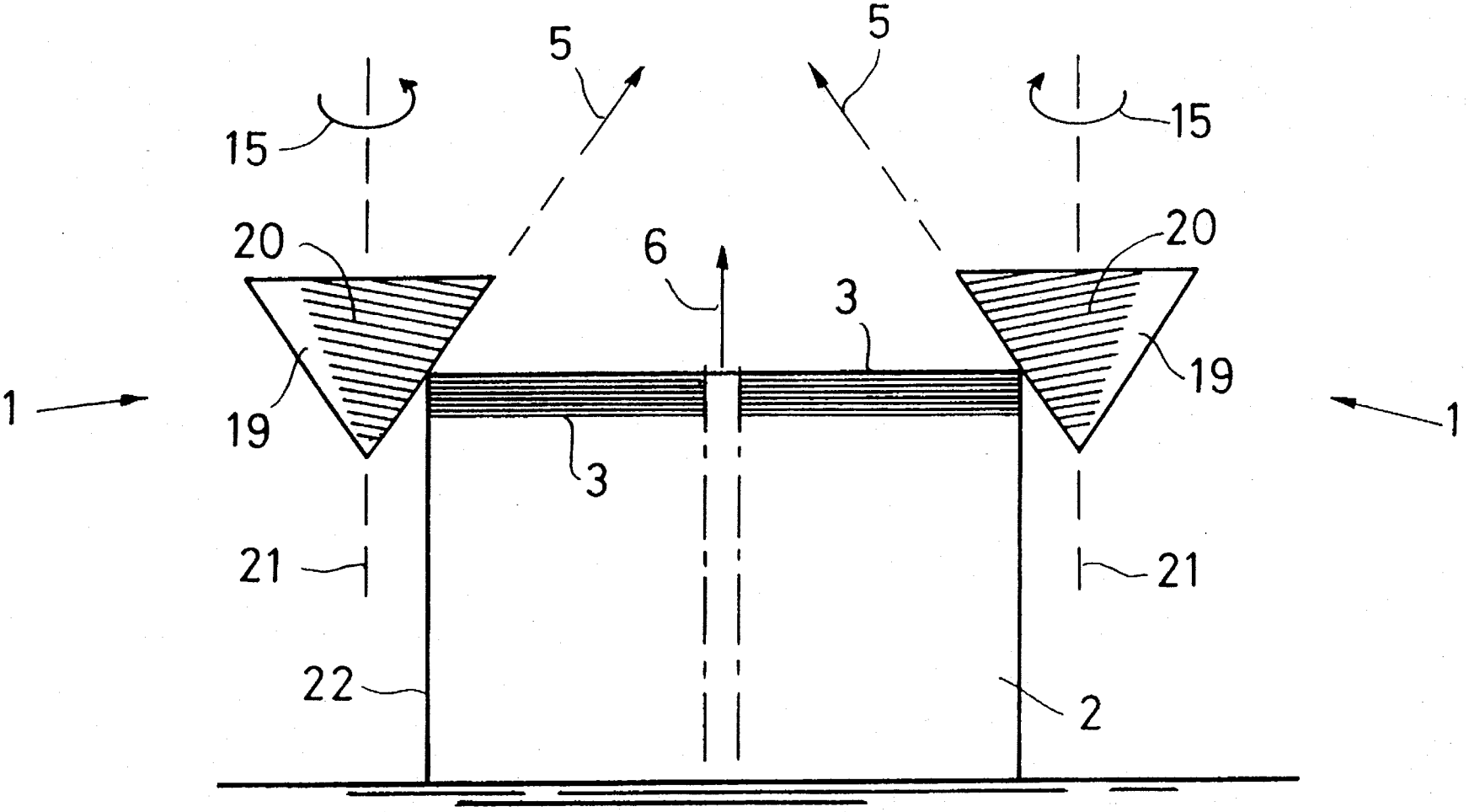
FIG. 4 is a view corresponding to that of FIG. 1 of a second embodiment of the present invention.

FIG. 4 shows one alternative embodiment in which the two above-disclosed screws have been replaced by one or more, preferably two rotary bodies 19. On their circumferential surface, the rotary bodies have a thread 20 which is analogous with the thread of the screws 12.

The configuration of the rotary bodies 19 may generally be described as a solid of revolution in which the axis of rotation 21 may be vertical and parallel with the side edge 22 of the stack. Depending upon the design of the solid of revolution, the axis of rotation 21 may, however, also slope more or less in the same manner as the axis of rotation of the screws 12, but also in the opposite direction.

The generatrix of the solid of revolution 19 may be a straight line, in which event the solid of revolution is in the form of a truncated or whole cone. However, the generatrix may also be an outwardly convex curve. In the alternative with a straight generatrix, the feeding direction 5 will be constant throughout the entire height of the solid of revolution. If, on the other hand, the generatrix is a curved line, the feeding direction 5 will vary along the height of the solid of revolution and, with the curve bent in the abovedescribed manner, the angle between the feeding direction 5 and the separation direction 6 will decrease when the uppermost sheet 3 is transported upwards. In order to achieve this angular modification, the direction of the axis of rotation 21 may also be modified.

In order to prevent the two solids of revolution from crushing or powerfully deforming the sheet which is in motion upwards between them, the solids of revolution are movable in the horizontal plane towards and away from one another and are pretensioned at suitable force in a direction in towards the stack 2. This entails that, when the uppermost sheet migrates upwards, the distance between the axes of rotation 21 will increase in order rapidly once again to decrease when the uppermost sheet has arrived on the upper side of the solids of revolution or has been removed by the gripping device 4 so that thereby the threads 20 once again come into engagement with the stack.

As an alternative to the movement in the horizontal plane of the solids of revolution 19, the direction of their axes of rotation 21 may be modified so that the solids of revolution are inclined or pivoted outwards from one another when the sheet 3 migrates upwards.

Also in this embodiment, rotation of the solids of revolution 19 takes place in opposite directions as shown by means of the arrows 15. Also in this embodiment, use is suitably made of an abutment 17 for positioning the upper, destacked sheet 3.

Figure 5:
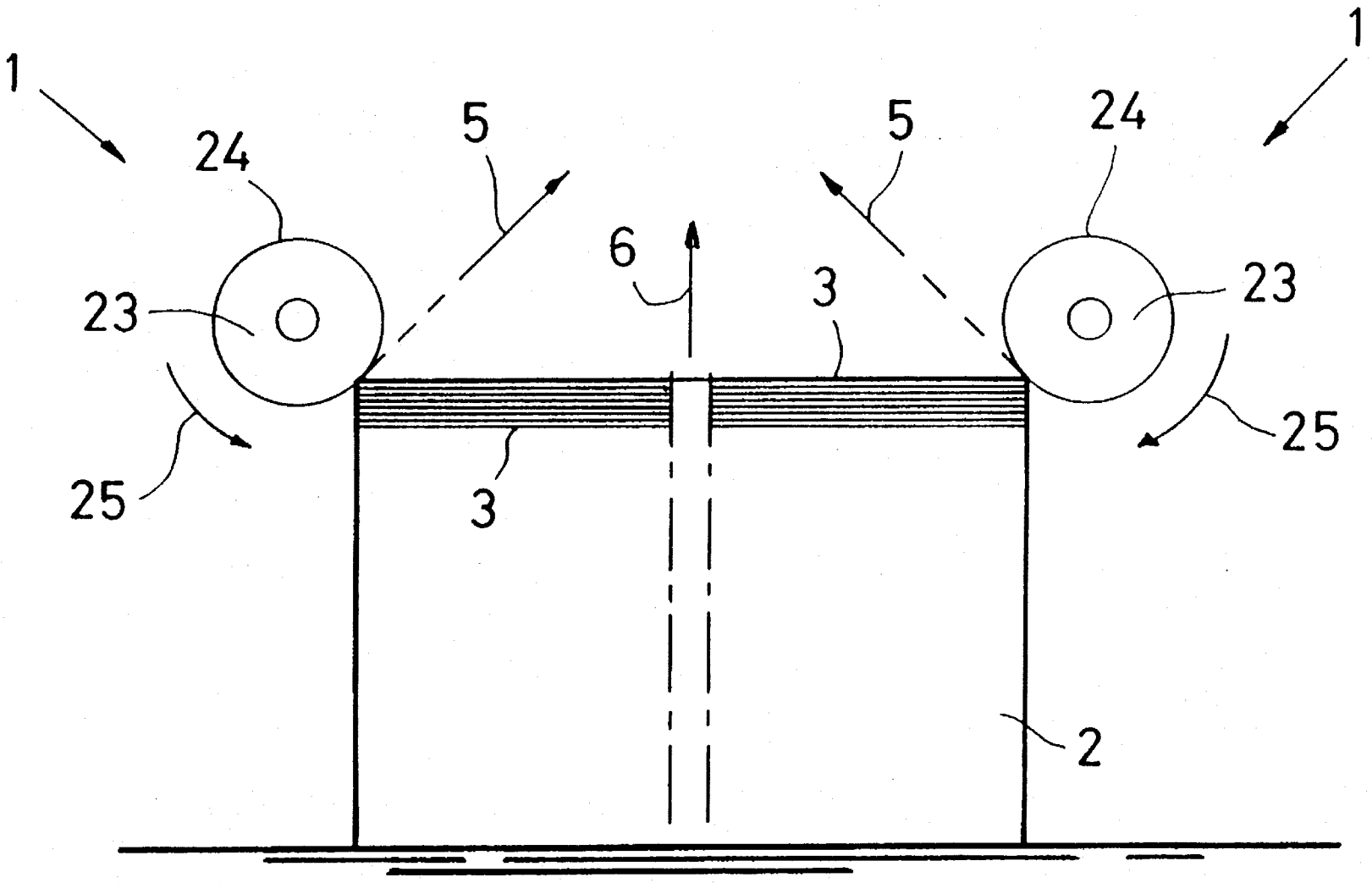
FIG. 5 is a view corresponding to that of FIG. 1 of a third embodiment of the present invention.

In the embodiment according to FIG. 5, the separator devices consist of one or more, preferably two wheels 23 or rotary disks which, with their periphery 24, abut against upper, preferably opposing edges of the stack 2. The wheels 23 carry a peripheral coating which gives a high friction in relation to the sheets 3 included in the stack, or also a grooved surface in which the distance between adjacent grooves corresponds to that described above for the threads of the screws 12. Furthermore, the longitudinal direction of the grooves is parallel with the edges of the sheets 3 included in the stack 2.

The wheels 23 rotate in opposite directions, which is intimated by the arrows 25. This entails that the feeding directions 5 will lie along the tangents of the wheels in the point of contact with that sheet which is to be destacked and separated. According as the sheet migrates upwards, the feeding directions will make a steadily decreasing angle with the separation direction 6 if the wheels are placed at a constant height above the stack 2. Also in this embodiment, it is necessary that the wheels 23 can move away from one another during a separation cycle, which may be achieved in that the journals of the wheels are movable horizontally (approximately in the plane of extent of the uppermost sheet 3). Alternatively, the journals of the wheels 23 may be suspended in pendulum arms so that the wheels may thereby be pivoted away in pendulum motion.

In this embodiment, the abutment 17 may be dispensed with, since the wheels 23 give no force component corresponding to the force component in the direction 16 in FIG. 2.

Figure 6:
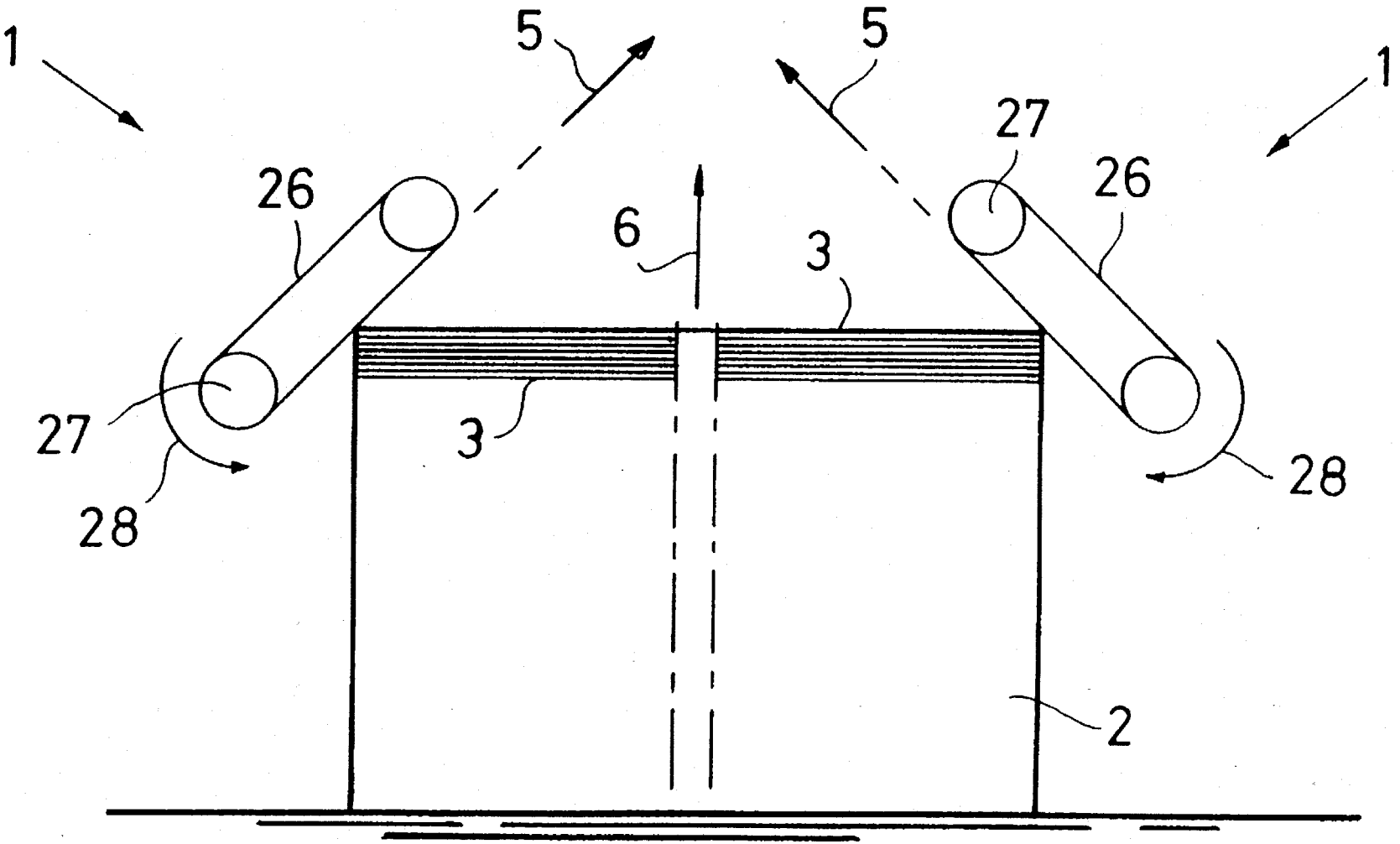
FIG. 6 is a view corresponding to that of FIG. 1 of a fourth embodiment of the present invention.

In the embodiment according to FIG. 6, the separator devices 1 consist of one or more, preferably two endless circulating belts 26. The belts run over rotary rollers or rolls 27 which rotate in accordance with the arrows 28 in opposite directions. Hereby, the belts 26 will have feeding directions 5 which correspond to the direction of those belt parts which abut against the stack. In the same manner as that which applied to the periphery of the wheels 23 in the embodiment according to FIG. 5, the belts 26 have grooves or friction-increasing coatings on their faces engaging with the stack, this transferring the force to the sheets.

Nor in this embodiment is there any need for a counterpart to the abutment 17, since the belts 26 do not give a force component in the plane of extent of the sheets along the direction 16 illustrated in FIG. 2.

In this embodiment, the angle between the feeding direction 5 and the intended separation direction 6 may be reduced during a separation cycle in that the assembly of belt/rollers is pivoted about the rotation axis of the lower roller 27 included in each assembly. Possibly, it is also conceivable that the assemblies are displaced in a horizontal direction away from one another in order to make requisite room for the destacked and separated sheet.

Figure 7:
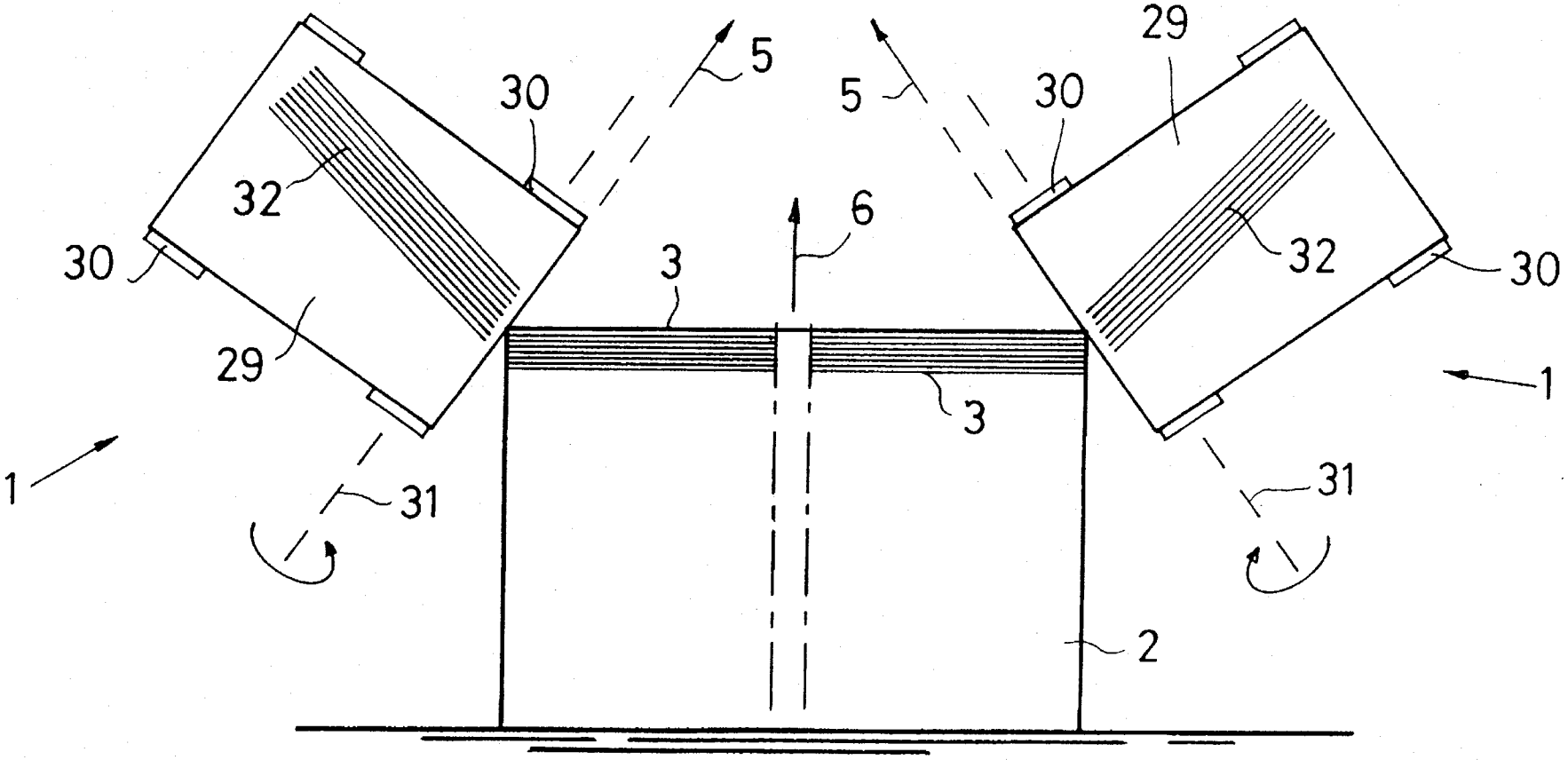
FIG. 7 is a view corresponding to that of FIG. 1 of a fifth embodiment of the present invention.

In the embodiment according to FIG. 7, the separator devices 1 consist of one or more, preferably two endless, circulating belts 29 which are supported and which turn about or between rollers 30. The rollers 30 in each separator device 1 have axes of rotation 31 which are parallel with one another and which are also parallel with the feeding directions 5 of the separator devices.

In order to achieve the sought-for destacking and separation of the sheets 3, the belts 29 are provided, on their outer faces abutting against the stack 2, with a grooving 32 in which the direction of the grooving is such that that part of the grooving which is "passed about" the roller 30 located in abutment with the stack 2 will form a thread on the surface of the roller the grooving 32 thus has an angle of pitch in relation to a diameter plane to the rotating rollers 30. The distance between adjacent grooves corresponds to that disclosed for the thread of the screws 12 in the embodiment according to FIGS. 1–3.

Also in this embodiment, the roller belts of the assembly must be movable in analogy with that described above.

Figure 8:
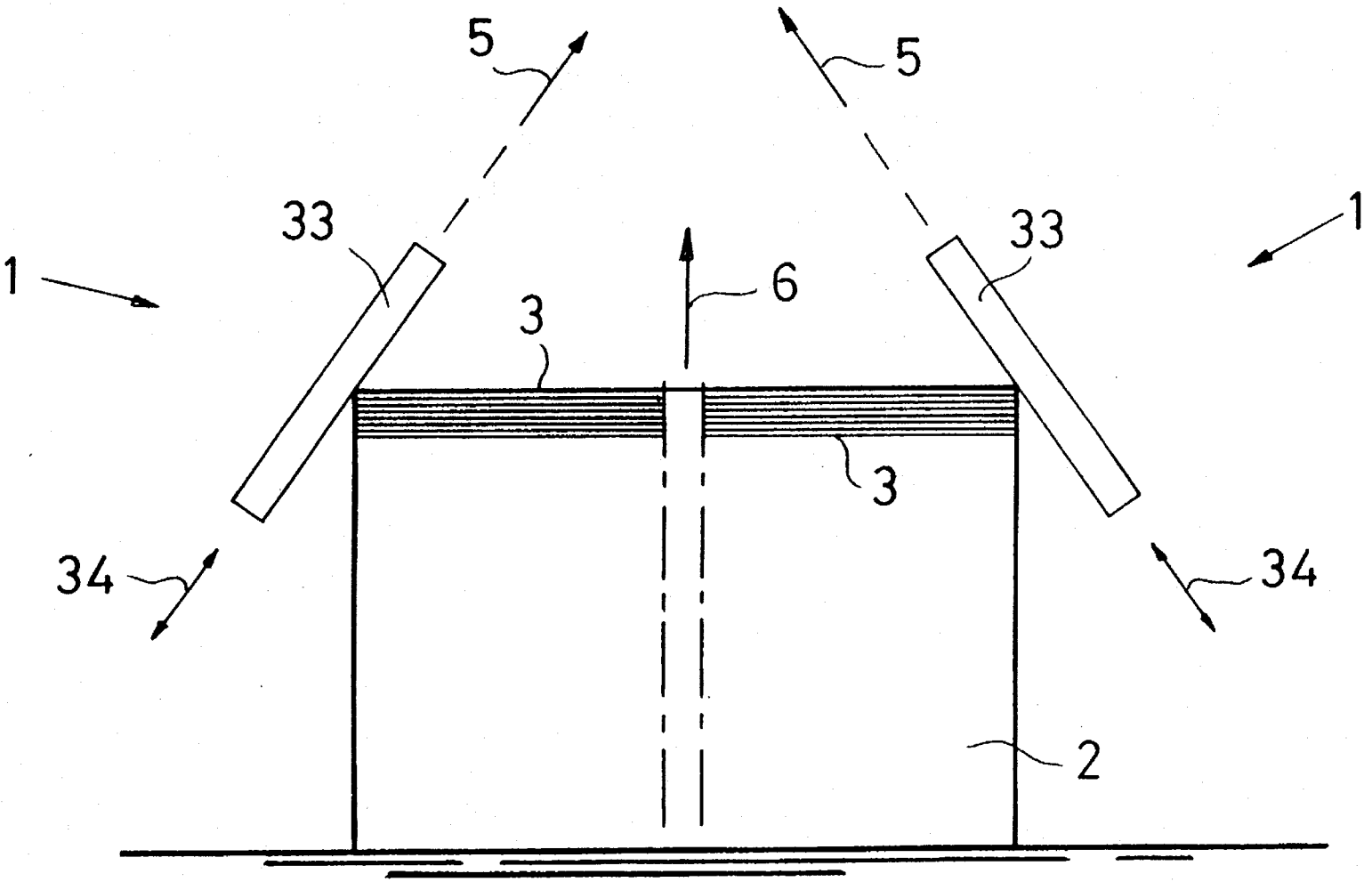
FIG. 8 is a view corresponding to that of FIG. 1 of a sixth embodiment of the present invention.

In the embodiment according to FIG. 8, the separator devices 1 consist of one or more, preferably two feeder devices 33 which are elongate and linearly reciprocal in accordance with the arrows 34. The feeder devices 33 are provided, on their sides facing the stack 2, with a transversely directed groove (parallel with the upper edge line of the stack), the distance between adjacent grooves corresponding to that mentioned above for the thread of the screws 12.

Superposed on the reciprocal movement according to the arrow 34 of the feeder device 33, there is also a pendulum pivotal motion, which implies that the upper ends of the feeder devices can be brought to a greater distance from one another so that thereby requisite room will be created for the sheet 3 being fed.

Further modifications are conceivable without departing from the spirit and scope of the appended claims.

We claim:

1. An apparatus for destacking, or separating, sheet or panel-shaped, substantially planar objects such as sheet metal members which form a stack, comprising at least one separator device engaging the stack and presenting to the stack a number of engagement members which, seen from the stack, are movable in a feeding direction forming art angle with a normal to the plane of the object to be separated and apparatus for turning the separator device to apply a force in the feeding direction, the separator device, with a portion engaging the stack, movable towards and away from the stack and yieldably biased against an edge portion of an object to be separated.

2. The apparatus as claimed in claim 1, characterized by two separator devices disposed at opposing edges of the stack and whose feeding directions make substantially equal but counter-directed angles with a normal to the plane of that object to be separated.

3. The apparatus as claimed in claim 2, characterized in that the separator devices are substantially cylindrical screws.

4. The apparatus as claimed in claim 3, characterized in that the screws are driven in opposite directions, whereby the object to be separated is subjected to a force approximately in the plane of the object; and that an abutment is provided so as to inhibit displacement of the object to be separated in the direction of the abutment.

5. The apparatus as claimed in claim 3, characterized in that the screws are provided with drive means pivotally disposed about shafts extending substantially parallel with edges of the stack engaged by the screws; and that the shafts are disposed such a distance from the stack that the screws are pivoted by force of gravity to positions where the screws engage the stack.

6. The apparatus as claimed in claim 2, characterized in that the separator devices are displaceable such that portions of the two separator devices engaging the object to be separated are movable towards and away from one another.

7. The apparatus as claimed in claim 1, characterized in that the distance between two adjacent engagement members seen from the stack is greater than the thickness of the object to be separated, preferably in the range of between 1.2 times said thickness and 1.8 times said thickness.

8. The apparatus as claimed in claim 7, characterized in that said distance is approximately 1.5 times said thickness.

9. The apparatus as claimed in claim 1, characterized in that the at least one separator device is replaceable for adaptation to the thickness of an object to be separated.

10. The apparatus as claimed in claim 1, characterized in that the separator device and the stack are adjustable in the vertical direction in relation to one another for adaptation of the relative height position as the stack is consumed.

11. The apparatus as claimed in claim 1, characterized in that the at least one separator device is a conical solid of revolution, having a circumferential surface provided with a thread in engagement with the object to be separated; and that the direction of a tangent to the solid of revolution in its region of engagement with the object substantially corresponding to the feeding direction.

12. The apparatus as claimed in claim 1, characterized in that the at least one separator device is a wheel having periphery in engagement with the object to be separated, the direction of a tangent to the wheel in the region of contact with the object substantially corresponding to the feeding direction and the wheel being rotary about a shaft which is approximately parallel with an edge of the object engaged by the wheel.

13. The apparatus as claimed in claim 1, characterized in that the at least one separator device comprises a grooved device movably disposed at least in their longitudinal direction, and having a direction of movement during one separation cycle substantially corresponding to the feeding direction.

14. An apparatus for destacking, or separating, sheet or panel-shaped, substantially planar objects such as sheet metal members which form a stack comprising:

at least one separator device comprising an endless, circulating belt in engagement with an edge of the object to be separated, the direction of circulation of the belt in the region of contact with the object to be separated substantially corresponding to a feeding direction forming an angle with a normal to the plane of the object to be separated; and rollers for carrying the belt about a shaft which extends approximately parallel to the edge of the object engaged by the belt;

the separator device movable toward and away from the stack and yieldably biased against an edge portion of an object to be separated.

15. An apparatus for destacking, or separating, sheet or panel-shaped, substantially planar objects such as sheet metal members which form a stack, comprising:

at least one separator device comprising an endless, circulating belt in engagement with an edge of the object to be separated, the belt being disposed about two rollers, each having a shaft extending parallel to a feeding direction forming an angle with a normal to the plane of the object to be separated, the belt having a groove which has a pitch in relation to the diameter plane of each of the rollers;

the separator device movable toward and away from the stack and yiedably biased against an edge portion of an object to be separated.

16. A method of destacking a plurality of substantially planar objects such as sheet metal members each extending in a plane and forming a stack, the method comprising the steps of:

applying to an edge of an object to be separated a separating force to move an object to be separated in a direction of separation which is substantially normal to the plane of the object to separated by yieldably pressing a separator device against an edge portion of the object to be separated and turning the separator device;

the separator device presenting a plurality of engagement members to the stack operative to apply a separating force to an edge of an object to be separated in a direction forming an acute angle with the direction of separation.

17. The method in accordance with claim 16 wherein the step of applying a separating force comprises applying a force having a first component extending in a direction substantially parallel to the direction of separation and a second force component directed inwardly towards the object and substantially parallel to the plane of the object to be separated, the method further comprising the step of reducing the angle between the first and second force components as the object to be separated is moved in the direction of separation.

18. The method in accordance with claim 17 comprises displacing the object to be separated substantially in the predetermined plane by application of the second force component and into contact with an additional separation device and applying an additional force having a first force component extending substantially in the direction of separation and a second force component extending toward the object to be separated and in a direction which is substantially parallel to the plane of the object to be separated.

19. The method in accordance with claim 18 wherein the separating force and the additional force each comprise a third force component applied to the object to be separated, the third force components extending substantially parallel with one another and the plane of the object to be separated.

* * * * *